US012716661B2

(12) United States Patent
De Vaulx et al.

(10) Patent No.: US 12,716,661 B2
(45) Date of Patent: Aug. 25, 2026

(54) ADVANCED DISTURBANCE ELEMENTS FOR IMPROVING PIPE PERFORMANCE

(71) Applicant: VALEO SYSTEMES THERMIQUES, Le Mesnil-Saint-Denis (FR)

(72) Inventors: Cédric De Vaulx, Le Mesnil-Saint-Denis Cedex (FR); Erwan Etienne, Le Mesnil-Saint-Denis Cedex (FR); Julio Guerra, Le Mesnil-Saint-Denis Cedex (FR); Kamel Azzouz, Le Mesnil-Saint-Denis Cedex (FR)

(73) Assignee: Valeo Systemes Thermiques, Le Mesnil-Saint-Denis (FR)

( * ) Notice: Subject to any disclaimer, the term of this patent is extended or adjusted under 35 U.S.C. 154(b) by 107 days.

(21) Appl. No.: 18/711,612

(22) PCT Filed: Nov. 23, 2022

(86) PCT No.: PCT/EP2022/083043
§ 371 (c)(1),
(2) Date: May 20, 2024

(87) PCT Pub. No.: WO2023/099315
PCT Pub. Date: Jun. 8, 2023

(65) Prior Publication Data

US 2025/0012523 A1 Jan. 9, 2025

(30) Foreign Application Priority Data

Nov. 30, 2021 (FR) ..... 2112710

(51) Int. Cl.
*F28F 13/12* (2006.01)

(52) U.S. Cl.
CPC ..... *F28F 13/12* (2013.01)

(58) Field of Classification Search
CPC .. F28F 1/422; F28F 1/126; F28F 1/426; F28F 13/12; F28D 1/05375
(Continued)

(56) References Cited

U.S. PATENT DOCUMENTS 6,510,870 B1 * 1/2003 Valaszkai ..... B21C 37/20 138/117
7,055,586 B2 * 6/2006 Sakakibara ..... F28F 3/02 165/158
(Continued)

FOREIGN PATENT DOCUMENTS

EP 1061319 A1 * 12/2000 ..... F28F 1/022
JP 2000205783 A * 7/2000 ..... F28D 1/0391
WO WO-2019025719 A1 * 2/2019 ..... F28F 1/04

OTHER PUBLICATIONS

English translation of WO 2019025719A1 (Year: 2019).*
(Continued)

*Primary Examiner* — Tho V Duong
(74) *Attorney, Agent, or Firm* — Osha Bergman Watanabe & Burton LLP

(57) ABSTRACT

A tube for a heat exchanger defining a fluid circulation channel is disclosed. The channel extends along a longitudinal direction and includes a first flat wall including at least one pair of disturbance elements. The pair of disturbance elements is formed by a first and second disturbance element. The first and second disturbance elements are formed by a local deformation of the first flat wall toward the inside of the tube. The first and second disturbance elements extend between a first base and a first crest and between a second base and a second crest respectively. The first crest has an elongate shape along a first straight line and the second crest has an elongate shape along a second straight line. The first
(Continued)

straight line intersects the second crest. The first and second crests have the same length measured between the two free ends of the crests.

8 Claims, 3 Drawing Sheets

(58) Field of Classification Search
USPC ..... 165/179
See application file for complete search history.

(56) References Cited

U.S. PATENT DOCUMENTS

| | | | | |
|---|---|---|---|---|
| 7,942,137 | B2 * | 5/2011 | Geskes | F28F 13/14 165/174 |
| 2002/0195239 | A1 | 12/2002 | Duerr et al. | |
| 2015/0247680 | A1 * | 9/2015 | Brunner | F28F 1/06 165/181 |
| 2016/0109188 | A1 | 4/2016 | Juliana et al. | |
| 2021/0207896 | A1 | 7/2021 | Bravo Rodriguez et al. | |

OTHER PUBLICATIONS

International Search Report issued in corresponding International Application No. PCT/EP2022/083043 mailed Jan. 24, 2023 (5 pages).
Written Opinion issued in corresponding International Application No. PCT/EP2022/083043 mailed Jan. 24, 2023 (5 pages).

* cited by examiner

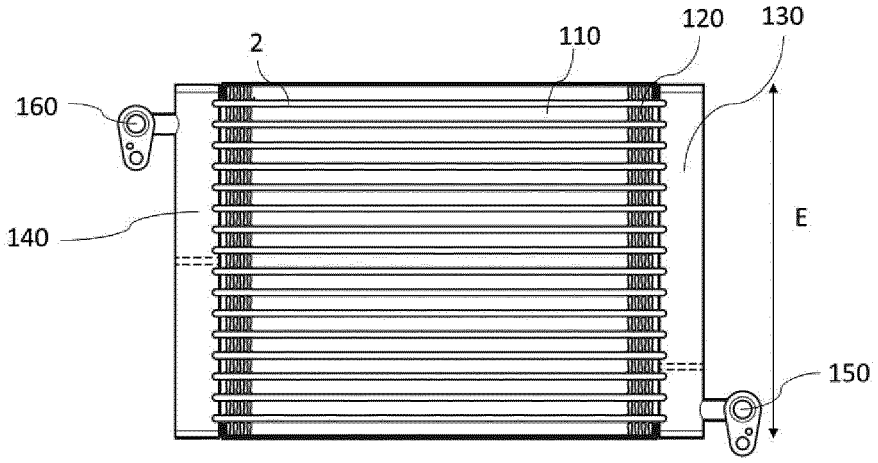
[Fig. 1]
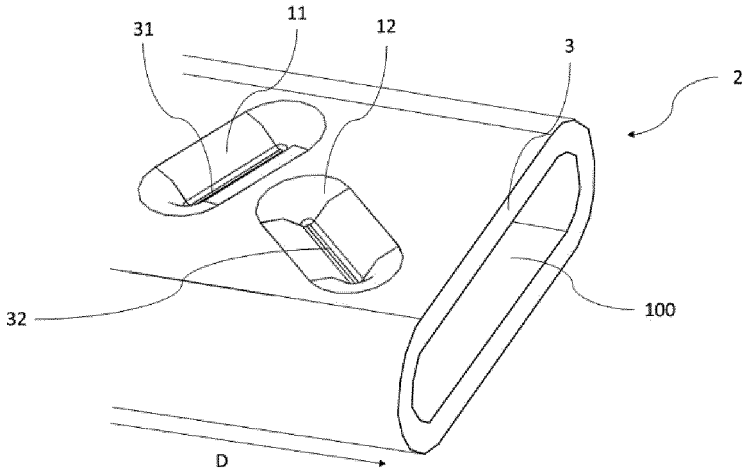
[Fig. 2]

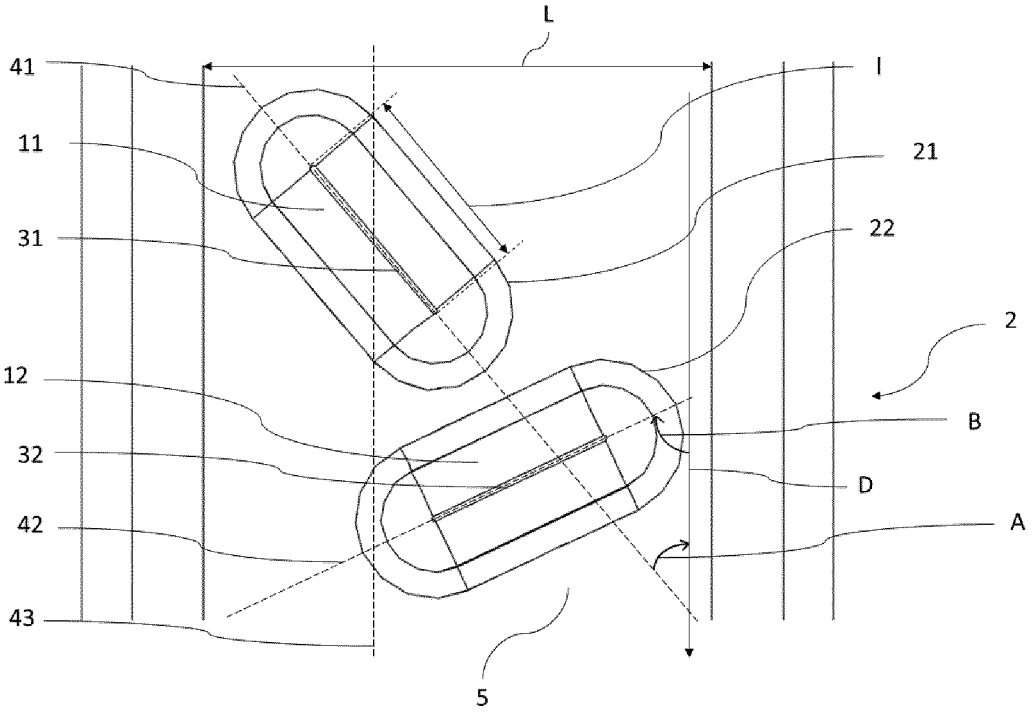
[Fig. 3]
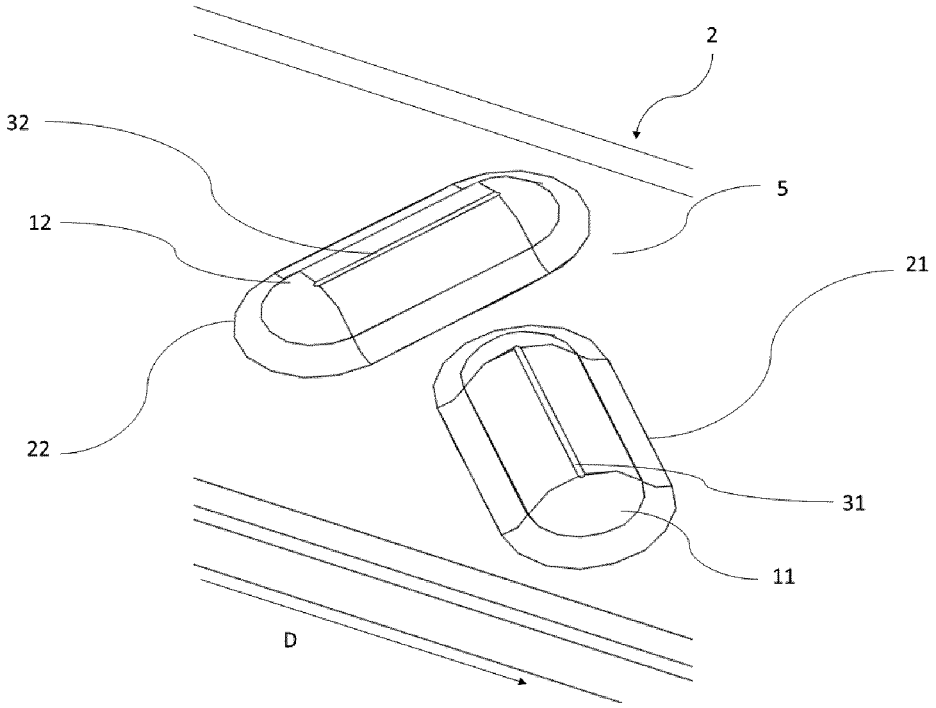
[Fig. 4]

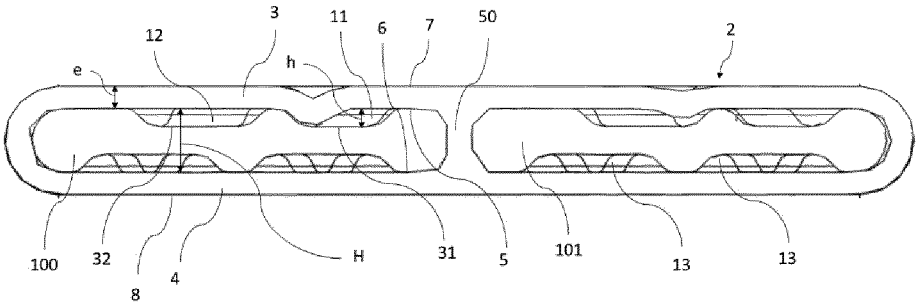
[Fig. 5]
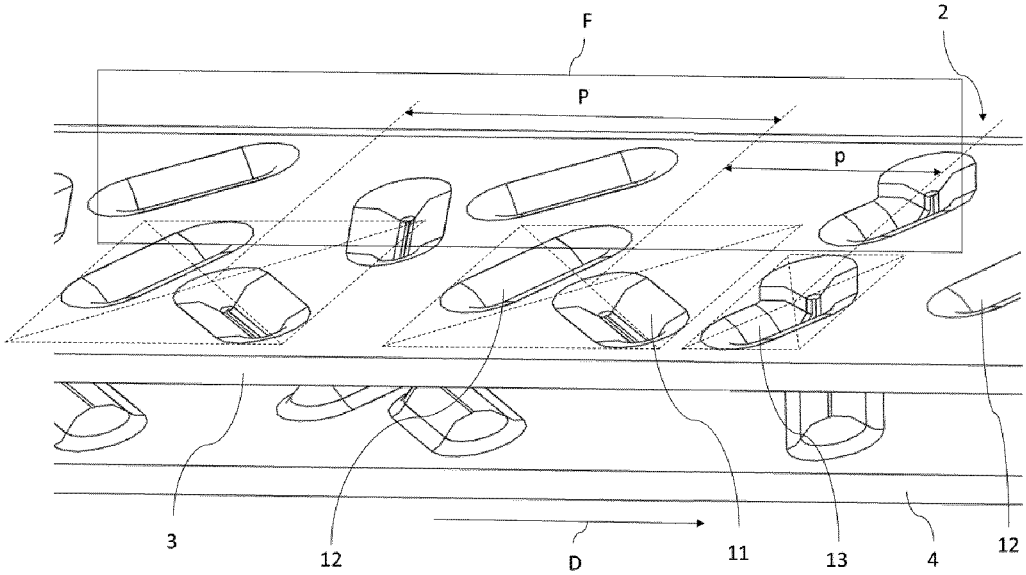
[Fig. 6]
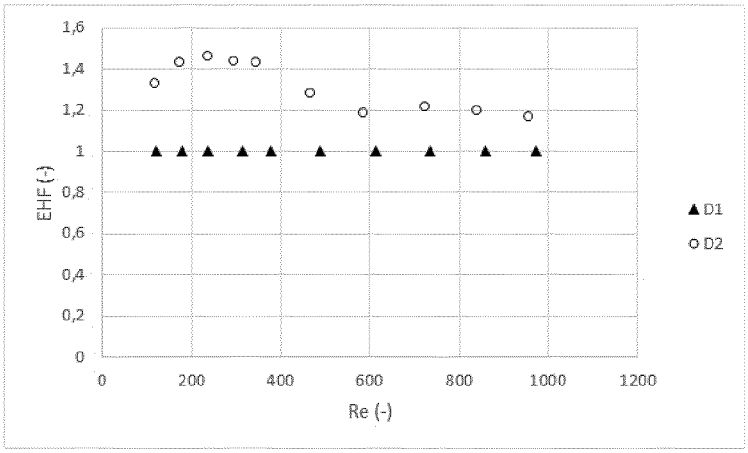
[Fig. 7]

ADVANCED DISTURBANCE ELEMENTS FOR IMPROVING PIPE PERFORMANCE

The field of the present invention is that of heat exchangers, notably intended to be fitted to air-conditioning loops in motor vehicles or to cool the engine of a vehicle.

The heat exchangers fitted notably to vehicle air-conditioning loops are arranged so as to allow the adjacent circulation, in two separate spaces, of two different fluids, such that heat is exchanged between the fluids without mixing them. One type of heat exchanger used in the automotive field, among others, is the tube exchanger, the exchanger being made up of a stack of tubes brazed to one another and arranged so as to define the spaces in which the fluids circulate. Within the heat exchangers and the thermodynamic circuits to which they are attached, the fluids circulate while dissipating or absorbing thermal energy.

The effectiveness of the heat exchangers and the thermodynamic circuits is mainly determined by the exchanges of heat between the fluids flowing through them. It is therefore sought to design heat exchangers in which the exchanges of heat between the fluids circulating within them are optimized. To this end, it is notably possible to seek a mixing of each fluid within the space in which this fluid circulates, with the aim of enhancing the exchanges of heat between the fluids, and it is known to fit the heat exchangers with elements for disturbing the flow of the fluids.

It is understood that, to enhance the mixing of the fluids, it is possible to increase the number of disturbance elements and it may thus be sought to position them closer to one another. However, this solution, although it makes it possible to improve the mixing and the quantity of heat exchange, does not satisfactorily solve the cited problem of optimizing the exchanges of heat, since increasing the number of disturbance elements causes a significant pressure drop which limits the circulation of the fluids and thus the effectiveness of the heat exchanger.

The aim of the present invention is therefore to overcome the drawbacks described above by designing a tube for a heat exchanger that is designed to improve the exchange of heat between the fluids flowing through the heat exchanger, by limiting notably the pressure drops undergone by these fluids.

More particularly, the invention relates to a tube for a heat exchanger defining a fluid circulation channel, said channel extending along a longitudinal direction. This tube has a first flat wall, comprising at least one pair of disturbance elements formed by a first disturbance element and a second disturbance element. The first and second disturbance elements are formed by a local deformation of said first flat wall toward the inside of the tube. The tube is characterized in that said first and second disturbance elements extend between a first base and a first crest and between a second base and a second crest, respectively. Said first crest has an elongate shape along a first straight line and said second crest has an elongate shape along a second straight line. Said first straight line intersects said second crest. A third straight line, parallel to the longitudinal direction and passing through the center of the first base, intersects the second base.

According to one of the aspects of the invention, the length of the tube is defined along the longitudinal direction, with the first wall extending along the longitudinal direction.

According to one of the aspects of the invention, the first and second disturbance elements are remote from one another.

According to one of the aspects of the invention, the first flat wall comprises a first internal face facing the fluid circulation channel.

According to one of the aspects of the invention, each of the first and second disturbance elements emerges from the first internal face from its base and culminates at its crest.

According to one of the aspects of the invention, the base of a disturbance element and the crest of said element have a homothetic relationship.

According to one of the aspects of the invention, the first and second disturbance elements extend into the fluid circulation channel, so as to disturb the flow of this fluid.

According to one of the aspects of the invention, each of the first and second crests is contained in a plane parallel to the first flat wall, in other words the altitude of each of the first and second crests relative to the first flat wall is substantially constant all along this crest.

According to one of the aspects of the invention, the tube has a second flat wall extending along the longitudinal direction, this second flat wall being parallel to the first flat wall.

According to one of the aspects of the invention, the second flat wall comprises a second internal face facing the fluid circulation channel.

According to one of the aspects of the invention, the intersection between the first straight line and the longitudinal direction forms an angle A of between 20° and 60°, notably between 30° and 50°, ideally 40°.

According to one of the aspects of the invention, the intersection between the second straight line and the longitudinal direction forms an angle B of between 45° and 85°, notably between 55° and 75°, ideally 65°.

The height h of a disturbance element is defined as the distance between the internal face of the wall bearing the disturbance element and the crest of said disturbance element, this distance being measured along a direction perpendicular to the first flat wall.

The height H of the channel is defined as the distance between the first internal face and the second internal face, this distance being measured along a direction perpendicular to the first flat wall.

According to one of the aspects of the invention, the disturbance elements forming the pair of disturbance elements have the same height h.

According to one of the aspects of the invention, the ratio of the height h of the disturbance elements to the height H of the channel is between 0.1 and 0.4, notably between 0.2 and 0.3.

According to one of the aspects of the invention, the first and second flat walls have a first and a second external face, respectively, facing the outside of the tube.

The thickness e of a flat wall is defined as the distance between the internal face of said flat wall and the first external face of said flat wall, measured along a direction perpendicular to the first flat wall.

According to one of the aspects of the invention, the ratio of the height h of the disturbance elements to the thickness e of the first flat wall is between 0.1 and 4.0, notably between 0.5 and 2.5.

According to one of the aspects of the invention, the first and second crests of the disturbance elements are spaced from one another by a distance of between 1 and 3 mm.

According to one of the aspects of the invention, the pairs of disturbance elements are arranged alternately on the first flat wall and on the second flat wall.

According to one of the aspects of the invention, two successive pairs of disturbance elements of one and the same flat wall that are aligned along the longitudinal direction are spaced from one another by a pitch of between 2 and 6 mm.

The pitch between two successive pairs of disturbance elements that are aligned along the longitudinal direction is defined as the distance between the geometric centers of the pairs of disturbance elements.

According to one of the aspects of the invention, the first straight line intersects the second crest between ⅓ and ⅔ of its length.

According to one of the aspects of the invention, the first internal face has a width L, defined along the first internal face and perpendicularly in relation to the longitudinal direction.

According to one of the aspects of the invention, the first crest and the second crest have the same length l, the length l being measured between the two free ends of the crest in question.

According to one of the aspects of the invention, the height h of the disturbance elements is between 0.1 and 0.6 mm, notably between 0.2 and 0.5 mm.

According to one of the aspects of the invention, the tube comprises a plurality of pairs of disturbance elements aligned in the longitudinal direction of the tube.

According to one of the aspects of the invention, the pairs of disturbance elements of one and the same flat wall are aligned alternately on a first and a second row, each row taking up largely half of the flat wall, the half being defined by a plane along both the longitudinal direction and a direction perpendicular to the flat wall, this plane passing through the middle of the width L of the internal face.

According to one of the aspects of the invention, the tube comprises additional disturbance elements, in addition to the pairs of disturbance elements, of which the crest has a different shape to the crest of the pairs of disturbance elements, whether this is a chevron shape, circular shape, rectangular shape or oval shape.

According to one of the aspects of the invention, the additional disturbance elements are interposed between two pairs of disturbance elements.

According to one of the aspects of the invention, the minimum spacing between the first crest and the second crest of a pair of disturbance elements is strictly less than the minimum spacing between any one of the first and second crests and any other crest of a disturbance element or of an additional disturbance element of one and the same flat wall.

According to one of the aspects of the invention, the number of additional disturbance elements aligned along a line perpendicular to the longitudinal direction and extending along the width L of the internal face is greater than one.

According to one of the aspects of the invention, a successive pair of disturbance elements and additional disturbance element of one and the same flat wall that are aligned along the longitudinal direction are spaced from one another by a pitch of between 1 and 7 mm.

According to one of the aspects of the invention, the pitch between either two pairs of disturbance elements or between a pair of disturbance elements and an additional disturbance element that are aligned along the longitudinal direction progressively increases along the longitudinal direction D of the tube.

According to one of the aspects of the invention, either the disturbance elements or the disturbance elements and the additional disturbance elements are made in one piece with the tube; in other words, the tube and the disturbance elements or the tube and the additional disturbance elements are manufactured from the same block of material, it not being possible to separate one from the other without causing the destruction of the tube.

According to one of the aspects of the invention, either the disturbance elements or the disturbance elements and the additional disturbance elements are manufactured by pressing, stamping or metal additive manufacturing.

According to one of the aspects of the invention, the tube has an intermediate wall dividing the internal duct defined inside the tube into two channels.

According to one of the aspects of the invention, either the disturbance elements or the disturbance elements and the additional disturbance elements are arranged on one and the other of the channels.

The invention also relates to a heat exchanger comprising a plurality of tubes connected to one another via two manifolds, characterized in that at least one of said tubes is in accordance with the invention, said plurality of tubes defining a circulation circuit for a fluid able to be disturbed by the disturbance elements and a circulation space for air.

The features, variants and different embodiments of the invention may be combined with one another, in various combinations, provided that they are not mutually incompatible or exclusive. In particular, variants of the invention may be envisaged that comprise only a selection of features that are described in the present description in isolation from the other described features, if this selection of features is sufficient to provide a technical advantage.

Other features and advantages of the invention will also become apparent from both the following description and from several exemplary embodiments given by way of nonlimiting indication with reference to the attached schematic drawings, in which:

FIG. 1 is a schematic representation, in a front view, of a heat exchanger formed by a plurality of tubes according to the invention.

FIG. 2 is a sectional view of a tube according to the invention, shown in perspective.

FIG. 3 is a sectional view of the inside of the tube along a plane parallel to the wall of the tube.

FIG. 4 is a top view, in section, of the inside of the tube, along a plane parallel to the wall of the tube, and of a disturbance element according to the invention.

FIG. 5 is a sectional view along the longitudinal direction of a tube according to the invention.

FIG. 6 is a sectional view of the inside of the tube along a plane which extends along the longitudinal direction and is perpendicular to the wall of the tube, according to an embodiment of the invention comprising multiple disturbance element geometries.

FIG. 7 is a graph outlining the change in the improvement factor as a function of the Reynolds number measured for a reference tube and for a tube according to the present invention.

FIG. 1 shows a heat exchanger 1 according to the invention, configured to be fitted to the front face of a vehicle, notably for a motor vehicle, and to allow notably an exchange of heat between two fluids including, by way of example, a fluid and a stream of air. The heat exchanger comprises a plurality of tubes 2 according to the invention, within which the fluid circulates. The tubes 2 are disposed parallel to one another along a stacking direction E, vertical in this case, and delimit a plurality of ducts in which the fluid can circulate.

The space between two successive tubes 2 according to the invention delimits a space 110 where a stream of air can circulate with a view to exchanging heat with the fluid circulating in the tubes 2. In order to enhance the exchanges of heat between the fluid and the stream of air, dissipators 120 in the form of fins are arranged in the space where the stream of air circulates. The role of these dissipators 120 is to increase the contact surface area with the stream of air in order to optimize the exchanges of heat between the fluid and the stream of air. In order to facilitate the reading of FIG. 1 and the vertical stacking of the tubes, the dissipators 120 have only been shown partially, it being understood that they can extend over the entire longitudinal dimension of the tubes between which these dissipators are arranged.

Each tube 2 according to the invention is connected to a first manifold 130 and to a second manifold 140 which make the fluid circulate and supply the tubes. The first manifold 130 is designed to distribute the fluid entering the heat exchanger 1 among the various tubes 2 making up said exchanger. The second manifold 140 is designed to collect the fluid that has passed through the tubes 2 so as to make it leave the heat exchanger 1. The first and second manifolds 130 and 140 are on opposite sides from one another in relation to the stack of tubes 2, each tube extending longitudinally so as to be connected at a first end to the first manifold 130 and at a second end to the second manifold 140.

The heat exchanger 1 furthermore comprises means for placing these manifolds in communication with a fluid circuit external to the heat exchanger 1, this fluid circuit not being shown here. The first manifold 130 is thus connected to a first connecting end piece 150, via which the fluid can enter the heat exchanger 1, the second manifold 140 being connected to a second connecting end piece 160 via which the fluid can leave the heat exchanger 1.

FIG. 2 outlines the arrangement of the disturbance elements according to the invention. The tube 2 for a heat exchanger 1 defines a fluid circulation channel 100, this channel having a longitudinal direction D. The length of this tube is defined along the longitudinal direction D.

This tube 2 has a first flat wall 3 extending along the longitudinal direction D. It comprises a pair of disturbance elements 11, 12 formed by a first disturbance element 11 and a second disturbance element 12 which are present on this first flat wall 3, in the fluid circulation channel 100, so as to disturb the flow of this fluid.

Each of the first and second disturbance elements 11, 12 notably has a local deformation of this first flat wall 3 of the tube 2 toward the inside of the tube 2.

FIG. 3 shows a sectional view of the tube along a plane parallel to the first flat wall 3 of the tube 2. The first and second disturbance elements 11, 12 extend between a first base 21 and a first crest 31 and between a second base 22 and a second crest 32, respectively, said first crest 31 having an elongate shape along a first straight line 41 and said second crest 32 having an elongate shape along a second straight line 42. The first straight line 41 intersects the second crest 32. A third straight line 43, parallel to the longitudinal direction D and passing through the center of the first base 21, intersects the second base 22.

The intersection between the first straight line 41 and the longitudinal direction D forms an angle A of between 20° and 60°, notably between 30° and 50°, ideally 40°. The intersection between the second straight line 42 and the longitudinal direction D forms an angle B of between 45° and 85°, notably between 55° and 75°, ideally 65°.

The first straight line 41 intersects the second crest 32 between ⅓ and ⅔ of its length.

The first and second disturbance elements 11, 12 are remote from one another. The first and second crests 31, 32 of the disturbance elements 11, 12 are spaced from one another by a distance of between 1 and 3 mm.

The first crest 31 and the second crest 32 have the same length l, the length l being measured between the two free ends of the crest in question.

The first internal face 5 has a width L, defined along the first internal face 5 and perpendicularly in relation to the longitudinal direction D.

FIG. 4 shows a top view in section, from the inside of the tube 2, of a pair of disturbance elements 11, 12. Each of the first and second disturbance elements 11, 12 emerges from the first internal face from its base 21, 22 and culminates at its crest 31, 32. The base 21, 22 of a disturbance element 11, 12 and the crest 31, 32 of said element have a homothetic relationship.

Each of the first and second crests 31, 32 is contained in a plane parallel to the first flat wall 3, in other words the altitude of each of the first and second crests 31, 32 relative to the first flat wall 3 is substantially constant all along this crest 31, 32.

FIG. 5 presents a sectional view along the longitudinal direction D of a tube 2 according to the invention. The first flat wall 3 comprises a first internal face 5 facing the fluid circulation channel 100. The tube 2 has a second flat wall 4 extending along the longitudinal direction D, this second flat wall 4 being parallel to the first flat wall 3. The second flat wall 4 comprises a second internal face 6 facing the fluid circulation channel 100.

The height h of the disturbance element 11 is defined as the distance between the first internal face 5 and the crest 31, this distance being measured along a direction perpendicular to the first flat wall 3.

The height H of the channel 100 is defined as the distance between the first internal face 5 and the second internal face 6, this distance being measured along a direction perpendicular to the first flat wall 3.

The disturbance elements 11, 12 forming the pair of disturbance elements have the same height h. The ratio of the height h of the disturbance elements 11, 12 to the height H of the channel is between 0.1 and 0.4, notably between 0.2 and 0.3.

The first and second flat walls 3, 4 have a first and a second external face 7, 8, respectively, facing toward the outside of the tube 2.

The thickness e of the first flat wall 3 is defined as the distance between the first internal face 5 and the first external face 7, measured along a direction perpendicular to the first flat wall 3.

The ratio of the height h of the disturbance elements 11, 12 to the thickness e of the first flat wall 3 is between 0.1 and 4.0, notably between 0.5 and 2.5.

The height h of the disturbance elements 11, 12 is between 0.1 and 0.6 mm, notably between 0.2 and 0.5 mm.

The tube 2 has an intermediate wall 50 dividing the internal duct defined inside the tube 2 into two channels 100, 101.

The tube 2 comprises additional disturbance elements 13 in addition to the pairs of disturbance elements 11. The disturbance elements 11, 12 and the additional disturbance elements are arranged in one and the other of the channels 100, 101.

FIG. 6 is a sectional view of the inside of the tube 2 along a plane which extends along the longitudinal direction D and is perpendicular to the first flat wall 3 of the tube 2, according to an embodiment of the invention comprising multiple disturbance element geometries. The pairs of disturbance elements 11, 12 are also arranged alternately on the first flat wall 3 and on the second flat wall 4.

The tube 2 comprises a plurality of pairs of disturbance elements 11, 12 aligned along the longitudinal direction D of the tube 2. Two successive pairs of disturbance elements 11, 12 of one and the same flat wall that are aligned along the longitudinal direction D are spaced from one another by a pitch P of between 2 and 6 mm. The pitch P between two successive pairs of disturbance elements 11, 12 aligned along the longitudinal direction is defined as the distance between the geometric centers of the pairs of disturbance elements 11, 12.

The pairs of disturbance elements 11, 12 of the first flat wall 3 are aligned alternately on a first and a second row, each row taking up largely half of the first flat wall 3, the half being defined by a plane F along both the longitudinal direction and a direction perpendicular to the first flat wall 3, this plane passing through the middle of the width L of the first internal face 5.

The tube 2 also comprises additional disturbance elements 13, in addition to the pairs of disturbance elements 11, 12, of which the crest has a different shape to the crest of the pairs of disturbance elements 11, 12, whether this is a chevron shape, circular shape, rectangular shape or oval shape. The additional disturbance elements 13 are interposed between two pairs of disturbance elements 11, 12.

The minimum spacing between the first crest 31 and the second crest 32 of a pair of disturbance elements 11, 12 is strictly less than the minimum spacing between any one of the first and second crests 31, 32 and any other crest of a disturbance element 11, 12 or of an additional disturbance element 13 of the first flat wall 3.

The number of additional disturbance elements 13 aligned along a line perpendicular to the longitudinal direction D and extending along the width L of the first internal face is greater than one.

A successive pair of disturbance elements 11, 12 and additional disturbance element 13 of the first flat wall 3 that are aligned along the longitudinal direction D are spaced from one another by a pitch p of between 1 and 7 mm. According to another aspect of the invention, either the pitch P between two pairs of disturbance elements 11, 12 or the pitch p between a pair of disturbance elements 11, 12 and an additional disturbance element 13 that are aligned along the longitudinal direction D progressively increases along the longitudinal direction D of the tube 2.

The disturbance elements 11, 12 and the additional disturbance elements 13 are made in one piece with the tube 2. In other words, the tube 2 and the disturbance elements 11, 12 and also the tube 2 and the additional disturbance elements 13 are manufactured from the same block of material, it not being possible to separate one from the other without causing the destruction of the tube 2. The disturbance elements 11, 12 and the additional disturbance elements 13 are manufactured by pressing, stamping or metal additive manufacturing.

FIG. 7 is a graph outlining the change in the improvement factor, EHF, as a function of the Reynolds number, Re, measured for a reference tube D1 and for a tube according to the present invention D2. These data result from experimental measurements. The improvement factor is defined as the ratio of the Nusselt number of the tube in question over the Nusselt number of the reference tube D1 to the equivalent Reynolds number, the total being divided by the ratio, to the power ⅓, of the friction factor of the tube in question over the friction factor of the reference tube D1 to the equivalent Reynolds number. The aim of this coefficient is to compare the improvement in the thermal performance while taking into account the impact on the resulting pressure drops.

The reference tube used here is a tube developed specifically for the high Reynolds numbers. The graph in FIG. 7 shows that the tube according to the invention has an improvement factor greater than the reference tube over the entire range tested, that is to say for Reynolds numbers from 100 to 1000. This improvement varies, depending on the flow rates, between 16% and 45%.

The invention claimed is:

1. A tube for a heat exchanger defining a fluid circulation channel, wherein the channel extends along a longitudinal direction and comprises a first flat wall comprising at least one pair of disturbance elements, wherein the pair of disturbance elements is formed by a first disturbance element and a second disturbance element, wherein the first and second disturbance elements are formed by a local deformation of the first flat wall toward the inside of the tube, wherein the first and second disturbance elements extend between a first base and a first crest and between a second base and a second crest, respectively, wherein the first crest has an elongate shape along a first straight line and the second crest has an elongate shape along a second straight line, wherein the first straight line intersects the second crest, and wherein a third straight line, parallel to the longitudinal direction and passing through the center of the first base, intersects the second base, wherein the first crest and the second crest have the same length, the length being measured between the two free ends of the crest in question, wherein two successive pairs of disturbance elements are aligned along the longitudinal direction and are spaced from one another by a pitch of between 2 and 6 mm, and wherein the tube comprises additional disturbance elements and wherein a crest of the additional disturbance elements has a different shape than the crest of the disturbance elements.

2. The tube as claimed in claim 1, wherein the intersection between the first straight line and the longitudinal direction forms an angle A of between 30° and 50°.

3. The tube as claimed in claim 1, wherein the intersection between the second straight line and the longitudinal direction forms an angle B of between 55° and 75°.

4. The tube as claimed in claim 1, wherein the ratio of the height h of the disturbance elements to the height H of the channel is between 0.2 and 0.3.

5. The tube as claimed in claim 1, wherein the ratio of the height h of the disturbance elements to the thickness e of the first flat wall is between 0.5 and 2.5.

6. The tube as claimed in claim 1, wherein the first and second crests of the disturbance elements are spaced from one another by a distance of between 1 and 3 mm.

7. The tube as claimed in claim 1, wherein the tube comprises a second flat wall parallel to the first flat wall, wherein the pairs of disturbance elements are arranged alternately on the first flat wall and on the second flat wall.

8. A heat exchanger comprising a plurality of tubes connected to one another via two manifolds, wherein at least one of the tubes is as claimed in claim 1, wherein the plurality of tubes defines a circulation circuit for a fluid able to be disturbed by the disturbance elements and a circulation space for air.

* * * * *